United States Patent [19]

Bianchetta

[11] 3,987,623

[45] Oct. 26, 1976

[54] CONTROLLED PRIORITY FLUID SYSTEM OF A CRAWLER TYPE VEHICLE

[75] Inventor: Donald L. Bianchetta, Coal City, Ill.

[73] Assignee: Caterpillar Tractor Co., Peoria, Ill.

[22] Filed: Jan. 23, 1976

[21] Appl. No.: 651,888

[52] U.S. Cl. ..... 60/422; 60/427; 60/452; 60/484; 60/486; 91/412

[51] Int. Cl.[2] ..... F15B 11/16; F15B 11/20

[58] Field of Search ..... 60/420, 422, 427, 428, 60/452, 484, 486; 91/412

[56] References Cited

UNITED STATES PATENTS

| | | | |
|---|---|---|---|
| 3,550,505 | 12/1970 | Byers | 91/412 X |
| 3,628,558 | 12/1971 | Bahl | 60/422 X |
| 3,861,145 | 1/1975 | Hall et al. | 60/427 |
| 3,863,448 | 2/1975 | Purdy | 60/422 |
| 3,908,375 | 9/1975 | Young | 60/422 |

*Primary Examiner*—Edgar W. Geoghegan
*Attorney, Agent, or Firm*—Frank L. Hart

[57] ABSTRACT

An improved fluid system of a crawler type vehicle has control means for selectively passing fluid in a preselected sequence to a plurality of work elements.

12 Claims, 5 Drawing Figures

10
12
14
16
34
36
38
40
42
44
48
50
52
54
56
58
60
61
64
66
70
74
76
78
80
82
98
100
102
104
134
"A"
"B"
"C"
"D"
"E"
"X"
a
b
c
d

CONTROLLED PRIORITY FLUID SYSTEM OF A CRAWLER TYPE VEHICLE

BACKGROUND OF THE DISCLOSURE

In the operation of crawler type vehicles, it is often desirable to assure that priority is given to the operation of selected work elements of a plurality of work elements. For example, it may be important that first and second track motors are assured of receiving sufficient fluid to satisfy their maximum fluid demand capacity even at the expense of not being able to supply the hydraulic fluid necessary to satisfy the demands of other work elements of the hydraulic system. An example where such a priority system would be important is in operating an excavator in extremely rugged terrain where it is desirable to always have full power available to operate the track motors.

Further, it is desirable that a priority system such as this be constructed to function from one or a plurality of pumps and the pump or pumps be controlled by a single control valve in response to the operating pressures of the plurality of working elements. It is also advantageous to control the maximum pressure subjected on each working element in order to reduce waste of energy and material.

This invention therefore resides in a controlled priority fluid system of a crawler type vehicle.

DETAILED DESCRIPTION OF THE INVENTION

Figure 1:
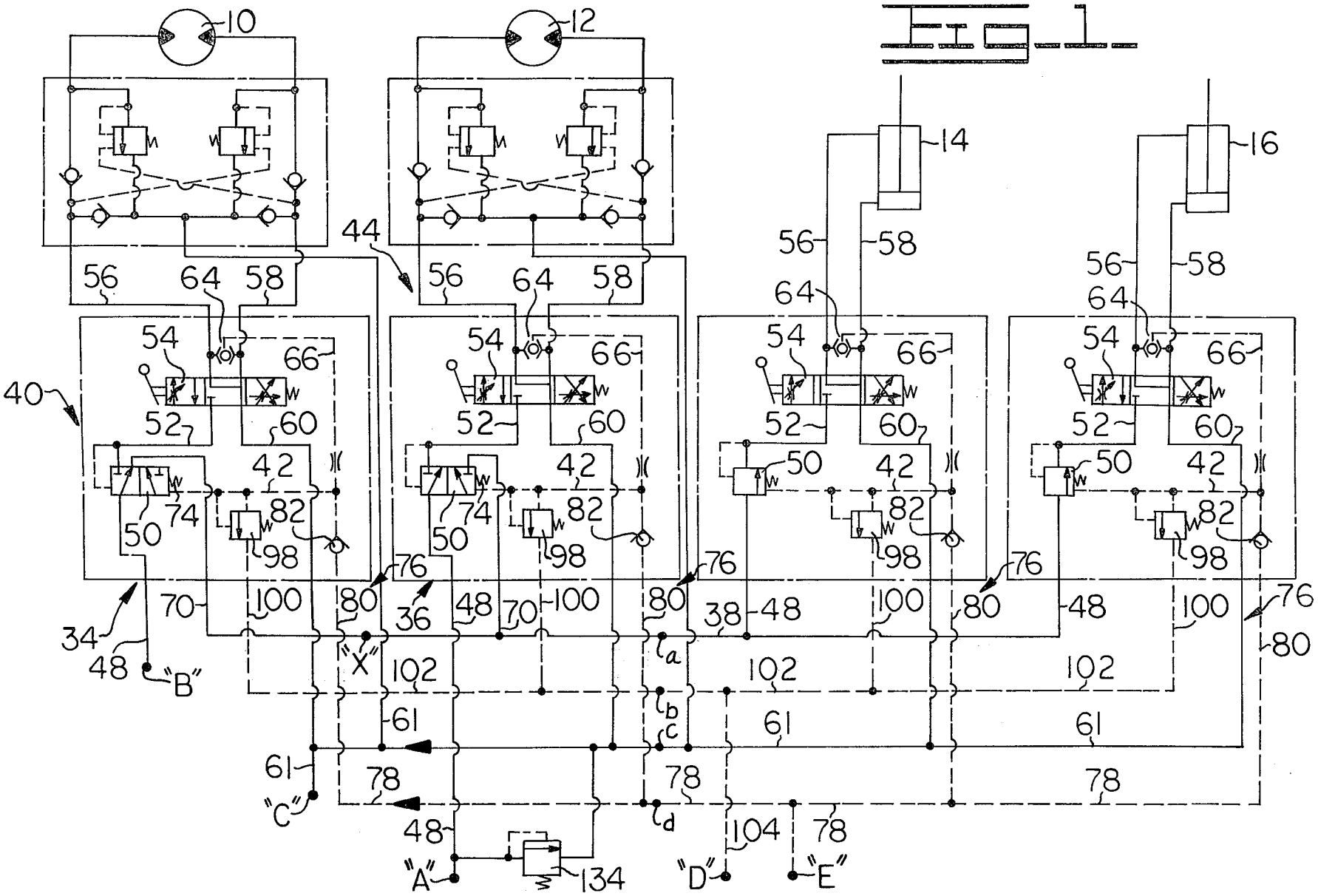
FIG. 1 is a diagrammatic view of one embodiment of a portion of the fluid system of a crawler type vehicle.

Referring to the drawings, FIG. 1 shows one embodiment of the working elements and their associated fluid system. The pumping system embodiments of FIGS. 2 and 3 can be used with either embodiment of the working element systems of FIG. 1 or FIG. 4 as set forth above. Other combinations can be constructed without departing from this invention.

Figure 4:
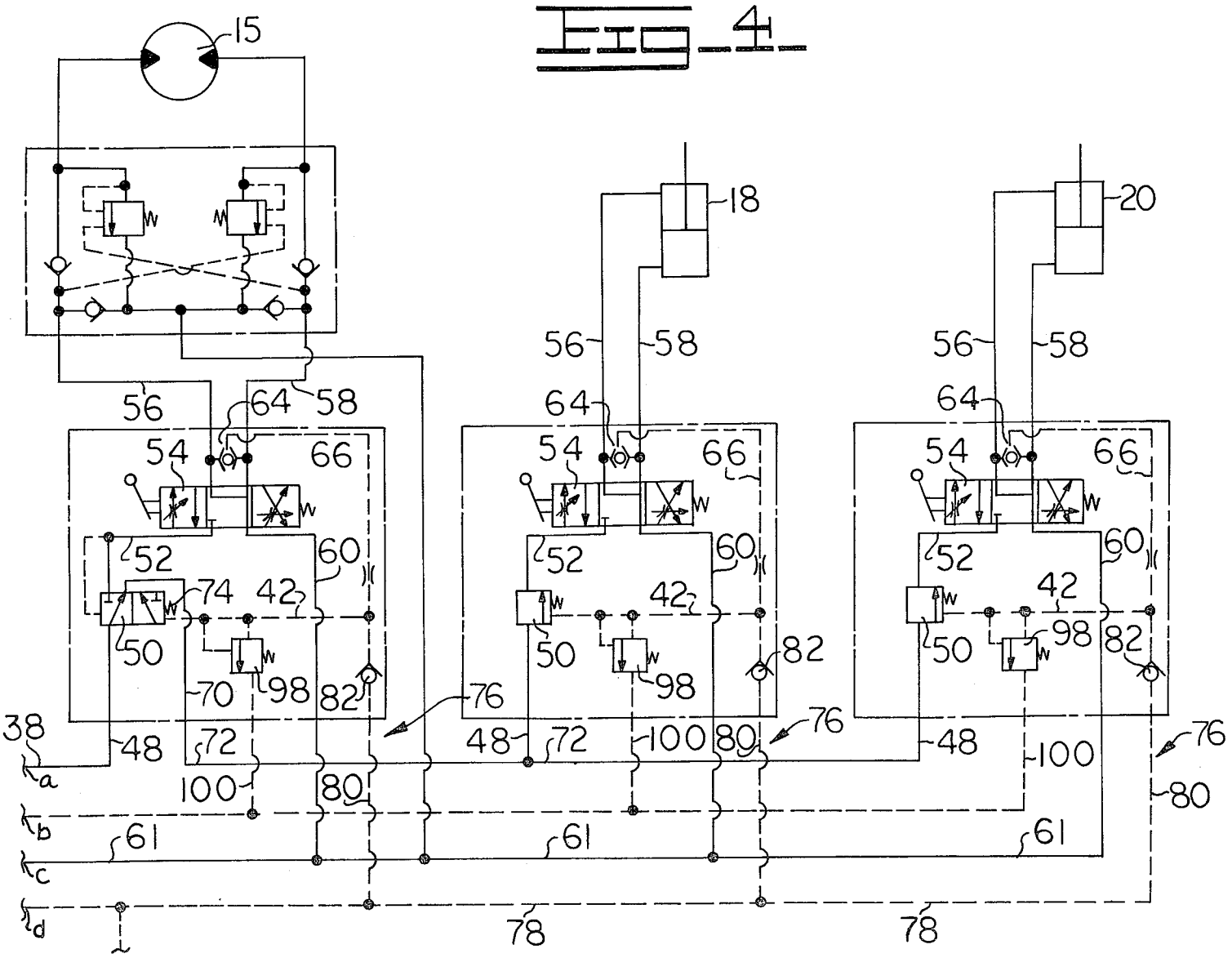
FIG. 4 is a diagrammatic view of another embodiment of a portion of the fluid system of a crawler type vehicle.

The fluid system, preferably hydraulic fluid system, of this invention has a plurality of primary work elements 10,12, and at least one secondary work element 14,15,16. In the embodiment of FIG. 4, there are a plurality of primary work elements 10,12, at least one secondary work element 15, and at least one tertiary work element 18,20.

Referring to FIG. 1, the primary work elements 10,12 can be for example right and left track motors of a crawler type vehicle, and the secondary work elements 14,16 can be for example respective actuating elements of the boom and bucket.

Referring to FIG. 4, the work elements can comprise for example the right and left track motors 10,12, as set forth above, connected as hereinafter more fully described, to at least one secondary work element 15, for example a swing motor, which in turn is connected to at least one tertiary work element 18, for example the actuating element of the boom.

The actuating elements 10,12,14,15,16,18,20 each comprise individual and separate but interconnected hydraulic fluid system portions and generally are constructed of common equipment. For simplicity and brevity, common elements of each system portion will generally be assigned common numbers.

Figure 2:
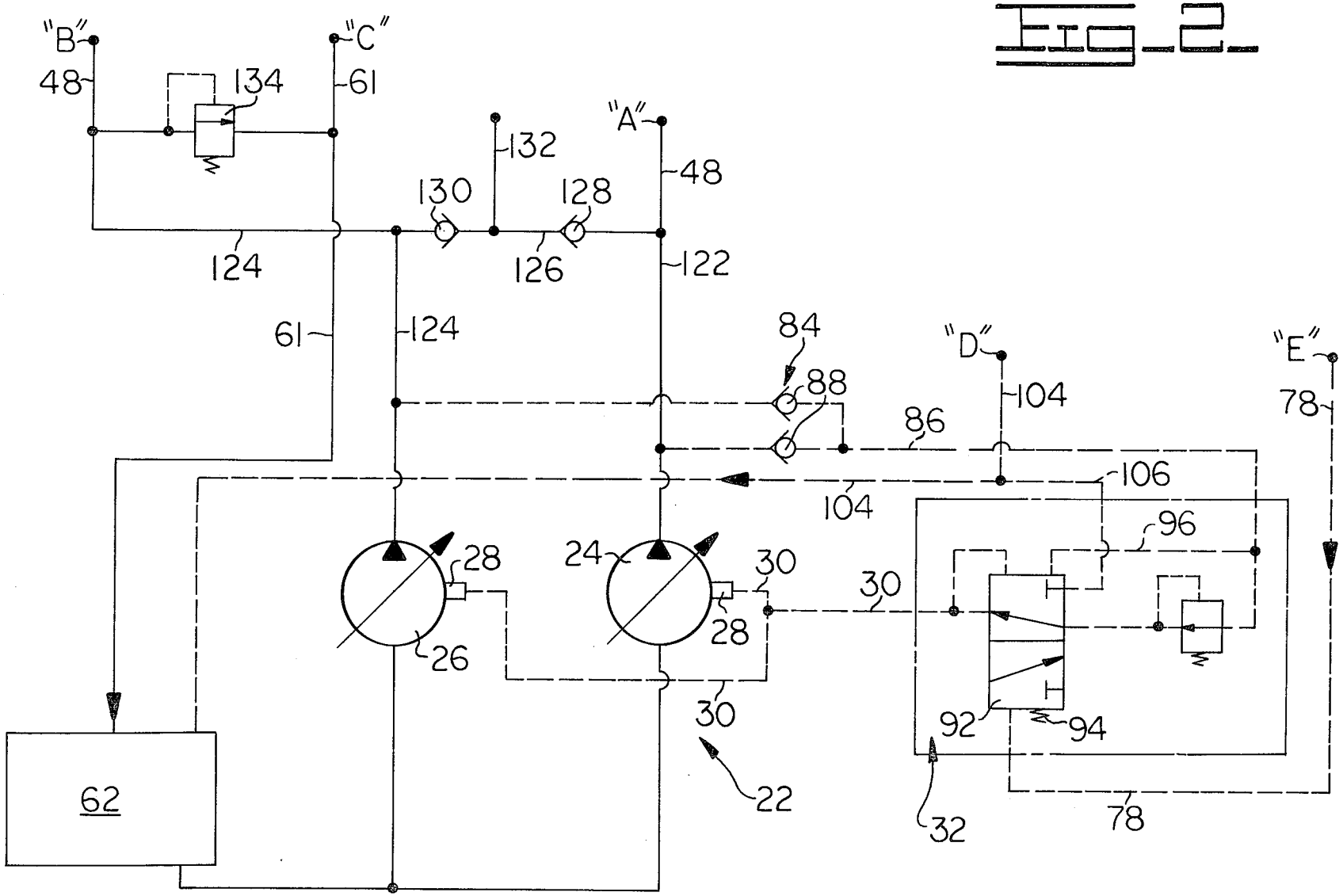
FIG. 2 is a diagrammatic view of one embodiment of the pumping means and pumping means control that can be utilized in the fluid system of FIG. 1.
Figure 3:
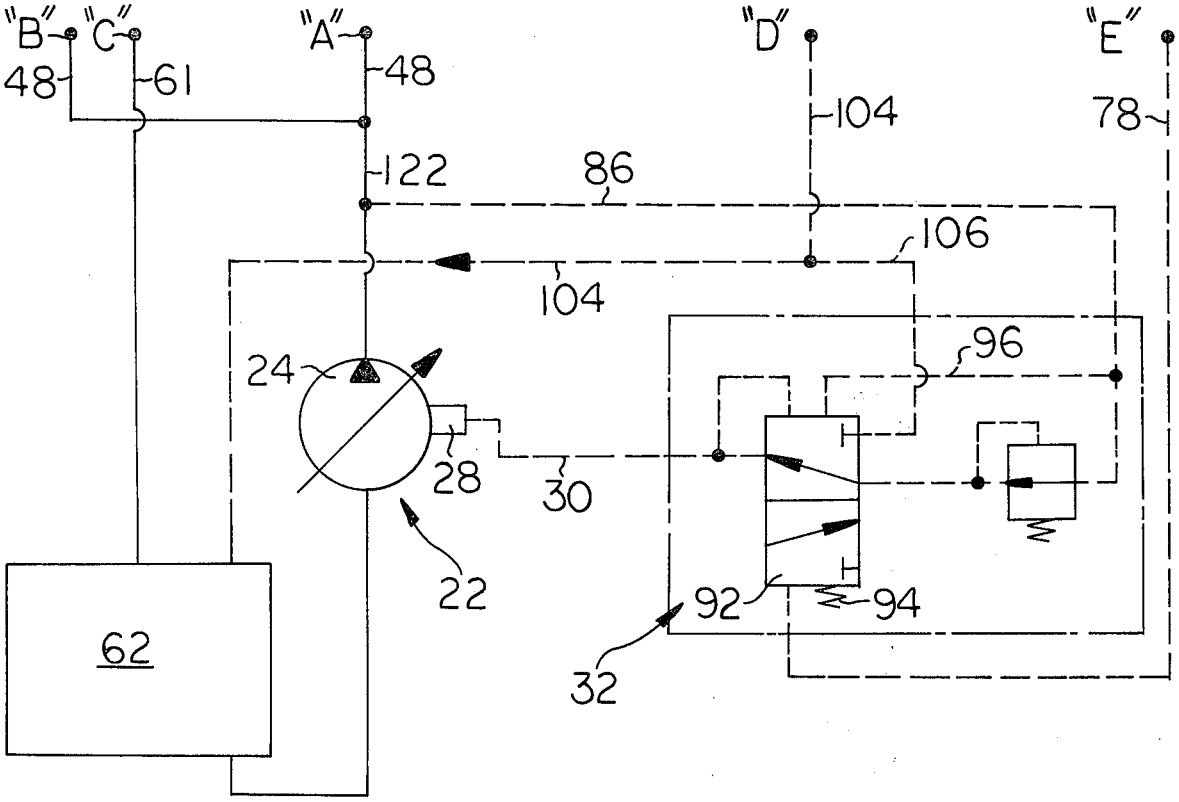
FIG. 3 is a diagrammatic view of another embodiment of the pumping means and pumping means control that can be utilized in the fluid system of FIG. 1.

Referring to FIGS. 2 and 3, the hydraulic fluid pumping means 22 can be provided with a single pump 25 (FIG. 3) or a plurality of pumps 24,26 (FIG. 2). Each pump 24,26 has individual control means 28, better shown in FIG. 5, for controlling the discharge rate of hydraulic fluid therefrom. Each pump control means 18 is connected to a signal conduit 30 for passing a hereinafter more fully described control signal from a single signal control means 32 to the pump control means 28 for altering the operation of the pumps 24,26 in response to said single signal.

The pumping means 22 of FIGS. 2 and 3 each preferably have a maximum fluid discharge capacity greater than the total maximum fluid intake capacity of the working elements 10, 12 when used with the embodiments of FIG. 1 or FIG. 4. In this and other constructions of the apparatus of this invention, it is preferred that the maximum fluid discharge capacity of the pumping means 22 be greater than the total maximum fluid intake capacity of the working elements that are given primary fluid delivering priority, as hereinafter more fully described.

Referring to FIGS. 1 and 4, each working element is associated with fluid control means for controlling the hydraulic fluid passing to and from the working elements.

A first means 34 is provided for delivering hydraulic fluid from the pumping means 22 (FIGS. 2 and 3) to the first primary work element 10 for the operation thereof.

A second means 36 is provided for delivering hydraulic fluid from the pumping means 22 to the second primary work element 12 for the operation thereof.

A first bypass conduit 38 is connected to the secondary working elements 14,16 (FIG. 1), 15 (FIG. 4) for delivering hydraulic fluid thereto for the operation thereof.

A third means 40 is provided for sensing the hydraulic pressure of the first primary work element 10, delivering a first signal through line 42 in response to said sensed pressure, and selectively passing fluid from the hydraulic system of the first primary work element 10 into the first bypass conduit 38 in response to said first signal being of a magnitude greater than a first preselected value.

A fourth means 44 is provided for sensing the hydraulic pressure of the second primary work element 12, delivering a second signal through line 42 in response to said sensed pressure, and selectively passing fluid from the hydraulic system of the secondary work element 12 into the first bypass conduit 38 in response to said second signal being of a magnitude greater than a second preselected value.

Therefore, primary work elements 10,12 are given priority for receiving all the hydraulic fluid they demand before fluid is passed into the first bypass conduit 38 which is the sole carrier of fluid for the operation of the secondary work elements 14,16 (FIG. 1) or 15 (FIG. 4). The first, second, third, and fourth means 34,36,40,44, as set forth above, are each preferably constructed of common elements and are common with hereinafter more fully described hydraulic system portions of work elements 15,16,18,20.

These hydraulic system portions of each working element 10,12,14,15,16,18,20 each have a line 48 connected at one end to a pressurized fluid source and at the other end to a flow control valve 50. Line 52 connects the flow control valve 50 to a directional control valve 54 which in turn is connected by control conduit 56 to one end of its respective work element. A control conduit 58 is connected to the other end of the respective work element and to the directional control valve 54 which in turn is connected via line 60 which leads to the hydraulic fluid reservoir 62 (FIGS. 2 or 3) of the system. For convenience, lines 60 can be connected to a common tank line 61.

As is known in the art of hydraulics, the directional control valve is movable between first and second positions for passing fluid to and from the respective work element through the control conduits 56,58.

A resolver valve 64 is in fluid communication with each pair of control conduits 56,58. The resolver valve 64 is of a construction sufficient for sensing the largest pressure in the respective pair of conduits 56,58 and delivering a signal through line 66 in response to said respective largest sensed signal.

The flow control valve 50 is connected via line 42 to line 66 for receiving the signal from the respective resolver valve 64.

In the embodiment of FIG. 1, the primary work elements 10,12 are the priority work elements of the system. In the embodiment of FIG. 4, the primary work elements 10,12 and the secondary work element 15 are priority work elements of the system. A study of the drawings will disclose that where the work element is a priority work element, the flow control valve 50 is a three-way, two-position valve as is known in the art. However, where the flow control valve 50 does not serve a priority work element, for example valve 50 serving work elements 14,16 of FIG. 1 and work elements 18,20 of FIG. 4, said valves are preferably two-way valves. However, said two-way valves may be three-way, two-position valves or others without departing from this invention.

Where the flow control valve serves a priority work element 10,12 (FIG. 1) and 10,12,15 of FIG. 4, the flow control valve 50 is connected to a discharge line 70 for selectively passing hydraulic fluid from downstream of said flow control valve 50 for controlling the pressure on the respective work element and associated hydraulic systems.

Referring to FIG. 4, primary work elements 10,12 are given first priority to fluid discharged from the pumping means and secondary work element 15 is given secondary priority and receives fluid discharged from either of the primary work elements 10,12, and the tertiary work elements 18,20 only receive fluid for the operation thereof which is discharged from the secondary work element 15.

In order to satisfy these selective priorities, line 70 of the primary work elements 10,12 is connected to the first bypass conduit 38 for passing fluid from valve 50 to downstream secondary work elements 14,16. Where the secondary work element is a work element of secondary priority, as for example 15 of FIG. 4, fluid discharged from the flow control valve 50 of element 15 passes through line 70 and into a second bypass conduit 72 which supplies fluid for the operation of downstream tertiary work elements 18,20.

The three-way flow control valve 50 serving work elements 10,12,15 is movable, as is known in the art, between a first position for passing fluid from the pressurized fluid source to the respective work element and a second position for passing fluid from the pressurized fluid source into line 70. The valve is biased toward the first position by a biasing means 74 having a preselected biasing force and the fluid pressure signal in line 42 and toward the second position by the fluid pressure in line 52.

Fifth means 76 is provided for sensing the control signals of lines 66 of the plurality of work elements, for example 10,12,14,16 (FIG. 1) and 10,12,15,18,20 (FIG. 4), and delivering a third signal in response thereto. The third signal is passed through line 78 and is the larger of sensed signals of lines 66.

The fifth means 76 comprises a plurality of signal conduits 80 connected at one end to a respective line 66 and at the other end to line 78. The signal conduits 80 each have a check valve 82 therein. The check valves 82 are oriented in a common direction for passing fluid from lines 66 into line 78.

Referring to FIGS. 2 and 3, a sixth means 84 is provided for sensing the discharge pressure of the pumping means 22 and delivering a fourth signal through line 86 in response thereto. Where the pumping means 22 comprises a plurality of pumps 24,26 as shown in FIG. 2, the sixth means 84 has a plurality of check valves 88 commonly oriented and are connected for passing fluid from the respective pumps 24,26 into line 86. In this construction, only the largest of the discharge pressures of the pumps 24,26 is delivered into line 86 as the fourth signal.

A signal control means 32 is provided for receiving the third signal from line 78 and the fourth signal from line 86, controllably altering said fourth signal and delivering a resultant fifth signal via signal conduit 30 to the pump control means 28. The fourth pressure signal is altered in response to the third and fourth signals and a preselected biasing force. The signal control means 32 comprises a spool valve 92 for altering the fourth signal by one end of said spool valve being acted on by the third pressure signal and a biasing means 94 and the other end being acted on by the fourth signal as delivered thereto by line 96 which is in communication with line 86.

Referring to FIGS. 1 and 4, a plurality of pressure relief valves 98 can each be connected to a respective line 42 for sensing the pressure of the respective first signal. Each of the valves 98 can be constructed to open at different preselected pressures for controllably passing fluid from respective lines 42 and thereby control the maximum pressure that is subjected onto the associated working elements 10,12,14,15,16,18,20. The relief valves 98 can each be connected via respective lines 100 to header lines 102 and 104 which lead to the hydraulic fluid reservoir 62 for returning discharged fluid thereto. The spool valve 92 can also be connected to line 104 via line 106 for passing discharged fluid from the signal control means 32 to the reservoir 62.

Figure 5:
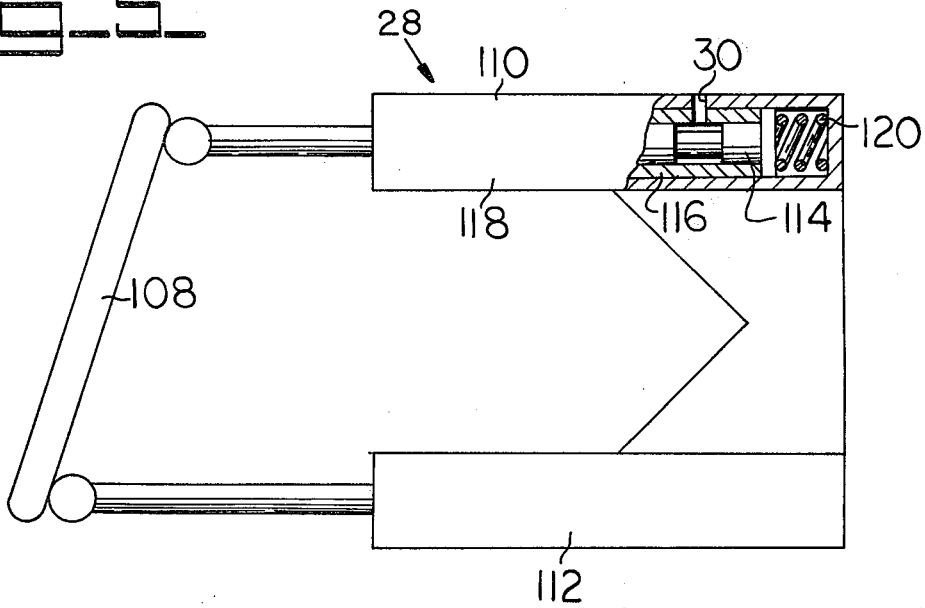
FIG. 5 is a diagrammatic view of the pump controls of the pumping means of FIGS. 2 and 3.

Referring to FIG. 5, the pump control means 28 comprises a movable swash plate 108 which is controllably movable between a maximum fluid discharge position for controlling the fluid that is discharged from the associated pump 24 or 26. A servo motor 110 is associated with the swash plate 108 for controllably moving the swash plate 108 toward one of a maximum fluid discharge position or a minimum fluid discharge position. Means 112 is provided for controllably moving the swash plate 108 toward the other of said maximum or minimum fluid discharge positions.

The servo motor 110 and means 112 are associated with the fluid discharge pressure of its respective pump and the fifth signal delivered through line 30. The servo motor is operable to move the swash plate in response to the fifth signal acting on an effective area of a spool valve 114 which is slidably movable within a sleeve 116 which also is slidably movable within the housing 118 of the servo motor 110. The spool valve 114 and sleeve 116 are biased in a first direction by biasing means 120 of the servo motor 110.

Such swash plate 108, servo motor 110, and means 112 assemblies of a pump control means 28 are known in the art and their construction and operation are more fully described in for example, U.S. Pat. No. 3,861,145, which issued Jan. 21, 1975 to Hall et al from an application filed Oct. 1, 1973, and which is assigned to Caterpillar Tractor Co.

Referring to FIG. 2, each pump 24,26 has a respective discharge conduit 122,124 connected to respective lines 48 serving a respective primary work element 10 or 12. Where there is a single pump 24 as in FIG. 3, the discharge conduit 122 is directly connected to line 48 of working element 10 and line 48 of working element 12.

In the embodiment of FIG. 2, conduit 126 connects pump conduits 122 and 124 in selective fluid communication. Conduit 126 has first and second check valves 128,130 positioned therein and each is oriented for passing fluid in a direction toward their adjacent respective pump conduit 122,124. A tie line 132 is connected at one end to conduit 126 and at the other to the first bypass conduit 38 of FIG. 1 at, for example location X on conduit 38.

By the construction of the primary work conduit 126 and associated elements, fluid delivered to one of elements 10 or 12 and being discharged into the first bypass conduit 38 can be utilized for supplementing the fluid being delivered to the other primary work element 10 or 12. This would also keep the main relief pressure valve of said one work element from opening when the vehicle is being turned wherein the track motor valve of said one work element is closed. This flow is combined with the working pump by tie line 132 and both pumps are controlled by one common seventh means 32.

A main pressure relief valve 134 can be associated with each pump 24,26 for controlling the pressure of the system.

Corresponding letter symbols A, B, C, D, and E have been placed on the drawings in order to assist the reader in connecting the pumps and associated equipment of FIGS. 2 or 3 to the work elements and associated equipment of FIGS. 1 or 4.

By the construction of the apparatus of FIG. 1 and FIGS. 2 or 3, the fluid demand of primary work elements 10,12 is satisfied before fluid is available through the first bypass conduit 38 for the operation of downstream work elements 14,16. By the construction of the apparatus of FIG. 1, FIG. 4, and FIGS. 2 or 3, the fluid demand of primary work elements 10,12 is satisfied before fluid is available through the first bypass conduit 38 for the operation of downstream work element 15 and the fluid demand of the secondary work element 15 is satisfied before fluid is available through the second bypass conduit 72 for the operation of downstream tertiary work elements 18,20. It should be understood that the number of primary, secondary, and tertiary work elements can change over that shown in the drawings without departing from this invention.

The construction as set forth above provides for pump controls in response to work element fluid demands, system protection through separate relief valves and control of a plurality of pumps through a single signal responsive to work element fluid demands.

Other aspects, objects, and advantages of this invention can be obtained from a study of the drawings, the disclosure, and the appended claims.

What is claimed is:

1. In a fluid system of a work vehicle having a pumping means having at least one pump serving at least two primary work elements and at least one secondary work element, the improvement comprising:

first means for delivering fluid from the pumping means to the first primary work element for the operation thereof;

second means for delivering fluid from the pumping means to the second primary work element for the operation thereof;

a bypass conduit connected to the secondary work element;

third means for sensing the fluid pressure of the first primary work element, delivering a first signal in response to said sensed pressure and selectively passing fluid from the first means into the bypass conduit in response to said first signal being of a magnitude greater than a first preselected value while maintaining said first primary work element free from communication with said first means; and fourth means for sensing the fluid pressure of the second primary work element, delivering a second signal in response to said sensed pressure, and selectively passing fluid from the second means into the bypass conduit in response to said second signal being of a magnitude greater than a second preselected value while maintaining said second primary work element free from communication with said first means.

2. Apparatus, as set forth in claim 1 wherein the first and fourth means each comprise:

a directional control valve positioned in the fluid pathway between the pumping means and the primary work element;

first and second control conduits connected to the respective directional control valve being in fluid communication with the respective primary work element;

a resolver valve in fluid communication with the first and second control conduits and being of a construction sufficient for sensing the largest pressure in said first and second control conduits and delivering a signal in response to said largest sensed pressure;

a flow control valve positioned in the fluid pathway between the pump and directional control valve and being connected to the resolver valve and the bypass conduit, said valve being biased toward a first position for passing fluid to the primary work element by a preselected biasing force and the signal from the resolver valve and toward a second position for passing fluid to the bypass conduit by the pressure of fluid downstream of the flow control valve.

3. Apparatus, as set forth in claim 1, including:

fifth means for sensing the first and second signals and delivering a third signal in response thereto, said third signal being the larger of said sensed first and second signals;

sixth means for sensing the discharge pressure of the pumping means and delivering a fourth signal in response thereto;

signal control means for receiving the third and fourth signals, altering said fourth signal in response to the third and fourth signals and a biasing force, and delivering a resultant fifth signal in response thereto; and pump control means for receiving the fifth signal and controlling the operation of the pump in response thereto.

4. Apparatus, as set forth in claim 3, wherein the signal control means has a spool valve, the pump control means has a movable swash plate, and the fifth means comprises:

check valves connected to respective third and fourth means for receiving said first and second signals, each check valve being oriented for delivering only the larger of said first and second signals to the signal control means as the third signal; and a servo motor associated with the swash plate for controllably moving the swash plate toward one of a maximum or minimum position in response to said fifth signal.

5. Apparatus, as set forth in claim 1, including:

a first control valve connected to the third means and being of a construction for passing fluid from the fluid system of the first primary work element in response to the first signal being greater than a first preselected value; and a second control valve connected to the fourth means and being of a construction for passing fluid from the fluid system of the second primary work element in response to the second signal being greater than a second preselected value.

6. Apparatus, as set forth in claim 1, where the pumping means comprises:

a first pump connected to the first means; and a second pump connected to the second means.

7. Apparatus, as set forth in claim 6, including:

fifth means for sensing the first and second signals and delivering a third signal in response thereto, said third signal being the larger of said sensed first and second signals;

sixth means for sensing the discharge pressure of the first and second pumps and delivering a fourth signal in response thereto, said fourth signal being the larger of the discharge pressures of said first and second pumps;

signal control means for receiving the third and fourth signals, altering said fourth signal in response to the third and fourth signals and a biasing force and delivering a resultant fifth signal in response thereto; and first and second pump control means for receiving the fifth signal and controlling the operation of said first and second pumps in response thereto.

8. Apparatus, as set forth in claim 7, wherein the signal control means is a spool valve and the first and second pump control means each have a movable swash plate, and including:

a servo motor associated with the swash plate for controllably moving the swash plate toward one of a maximum or minimum position in response to said fifth signal.

9. Apparatus, as set forth in claim 7, wherein the sixth means comprises:

check valves connected to respective first and second pumps, said check valves being oriented for delivering only the larger of said discharge pressures as the fourth signal.

10. Apparatus, as set forth in claim 6, including:

a first conduit connected to the discharge of the first and second pumps;

first and second pump discharge check valves positioned in the first conduit and each being oriented for passing fluid in a direction toward their respective pump; and a second conduit connected at one end to the first conduit at a location between said pump discharge check valve and at the other end to the bypass conduit.

11. Apparatus, as set forth in claim 1, wherein the fluid system includes at least one tertiary work element and including:

means for sensing the fluid pressure of the secondary work element delivering a signal in response to said sensed pressure and selectively passing fluid into the second bypass conduit in response to said signal being of a magnitude greater than a third preselected value.

12. Apparatus, as set forth in claim 11, wherein the means comprises:

a directional control valve connected to the first bypass conduit at a location between said first bypass conduit and the secondary work element;

first and second control conduits connected to said directional control valve and being in fluid communication with the secondary work element;

a resolver valve in fluid communication with said first and second control conduits and being of a construction sufficient for sensing the larger pressure in said first and second control conduits and delivering a signal in response to said largest sensored pressure;

a flow control valve positioned between the first bypass conduit and said directional control valve and being connected to said resolver valve and the second bypass conduit, said flow control valve being biased toward a first position for passing fluid to the secondary work element by a preselected biasing force and said signal and toward a second position for passing fluid to the second bypass conduit.

* * * * *

UNITED STATES PATENT AND TRADEMARK OFFICE

CERTIFICATE OF CORRECTION

PATENT NO. 3,987,623

DATED Oct. 26, 1976

INVENTOR(S) : Donald L. Bianchetta

It is certified that error appears in the above-identified patent and that said Letters Patent are hereby corrected as shown below:

In column 6 line 45, change "first" to read --- second ---.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*